US006454480B2

(12) United States Patent
Rigoni

(10) Patent No.: US 6,454,480 B2
(45) Date of Patent: Sep. 24, 2002

(54) HANDWRITING INSTRUMENT

(75) Inventor: Michael Rigoni, Nledereschach-Fischback (DE)

(73) Assignee: Jacob Ritter GmbH, Brensbach (DE)

( * ) Notice: Subject to any disclaimer, the term of this patent is extended or adjusted under 35 U.S.C. 154(b) by 0 days.

(21) Appl. No.: 09/870,281

(22) Filed: May 30, 2001

(30) Foreign Application Priority Data

May 30, 2000 (DE) ..... 200 09 728 U

(51) Int. Cl.[7] ..... B43K 7/12
(52) U.S. Cl. ..... 401/117; 401/195; 401/107
(58) Field of Search ..... 401/107, 110, 401/111, 116, 117, 195

(56) References Cited

U.S. PATENT DOCUMENTS 4,529,328 A * 7/1985 Wacha et al. ..... 401/117
4,606,665 A * 8/1986 Schleif et al. ..... 401/117
4,780,016 A * 10/1988 Kim ..... 401/117
5,547,301 A * 8/1996 Kageyama et al. ..... 401/99
6,273,626 B1 * 8/2001 Yazawa ..... 401/6

* cited by examiner

*Primary Examiner*—David J. Walczak

(57) ABSTRACT

A handwriting instrument consists of a top part (1) and a connected intermediate part (2), on the end of which a tip (3) is fastened. To make it possible to insert the intermediate part (2) into the top part (1) rapidly and securely during the assembly of the handwriting instrument, there are two detent elements (5) and two lead-in bevels (8) on the top part (1), which guide two flexible studs (4) into the detent elements (5), where the studs (4) are locked. A sleeve (11) fastened to the intermediate part (2) by means of a bayonet connection (13, 21; 12, 14, 20) covers the studs (4) and the detent elements (5). For easy handling of the writing instrument, there is a grip (18) made of non-slip butt soft rubber on the intermediate part (2).

8 Claims, 4 Drawing Sheets

HANDWRITING INSTRUMENT

BACKGROUND OF THE INVENTION

1. Field of the Invention

This invention relates to a handwriting instrument with a refill, the handwriting instrument consisting of an upper part, an intermediate part and a tip that can be fastened to the lower end of the intermediate part.

2. Description of the Related Art

A swing-out stamp with a stamp pad, for example, can be integrated into handwriting instruments of this type, but it requires a relatively complicated structure of the handwriting instrument. By way of example, a handwriting instrument with an integrated stamp and stamping pad is described in DE 298 00 041.

The user of a handwriting instrument wishes to have a writing instrument that is easy to handle and sturdy, and the manufacturer wishes to have a writing instrument that can be assembled from its individual parts easily, quickly and economically.

SUMMARY OF THE INVENTION

The objective of the invention is therefore to design a handwriting instrument so that it is sturdy and easy for the user to handle and can be assembled from its individual parts easily, quickly and economically.

The invention teaches that at least one flexible stud located on the intermediate part is guided into a diagonal connecting member of the upper part so that as a result of the rotation of the intermediate part relative to the upper part, the intermediate part can be displaced in the longitudinal direction relative to the upper part, whereby, depending on the direction of rotation, the tip of the refill is exposed or covered, and that on the lower end of the upper part there is an lead-in bevel to guide the studs when the intermediate part is inserted into the upper part.

The handwriting instrument claimed by the invention consists of an upper part, to which is connected an intermediate part, on the one end of which a tip is fastened. The tip is preferably screwed onto the intermediate part. For ease of writing, there is a grip on the intermediate part that is preferably made of a non-slip, soft rubber.

To assemble the handwriting instrument claimed by the invention, the upper end of the intermediate part with the two flexible studs is inserted into the lower end of the upper part, whereby the flexible studs are easily guided by the lead-in bevels into the detent elements, where they are locked in place. To be able to fix the intermediate part in either of the two limit positions, on each end of the detent elements there is a trough to lock the studs in place. The detent elements and the studs are covered by a sleeve that is inserted over them and they can be connected to and detached from the sleeve by means of a bayonet connector.

The interlocking of the detent elements results in a high degree of stability, while the lead-in bevels claimed by the invention significantly facilitate the assembly of the handwriting instrument claimed by the invention and simultaneously reduce the amount of time required to assemble a handwriting instrument as claimed by the invention.

By rotating the intermediate part relative to the top part, depending on the direction of rotation, the tip of a refill inserted into the handwriting instrument is either exposed or covered.

DESCRIPTION OF THE DRAWINGS

The invention is explained in greater detail below with reference to the exemplary embodiment and its individual parts which are illustrated in the accompanying figures, in which.

DETAILED DESCRIPTION OF THE INVENTION

Figure 1:
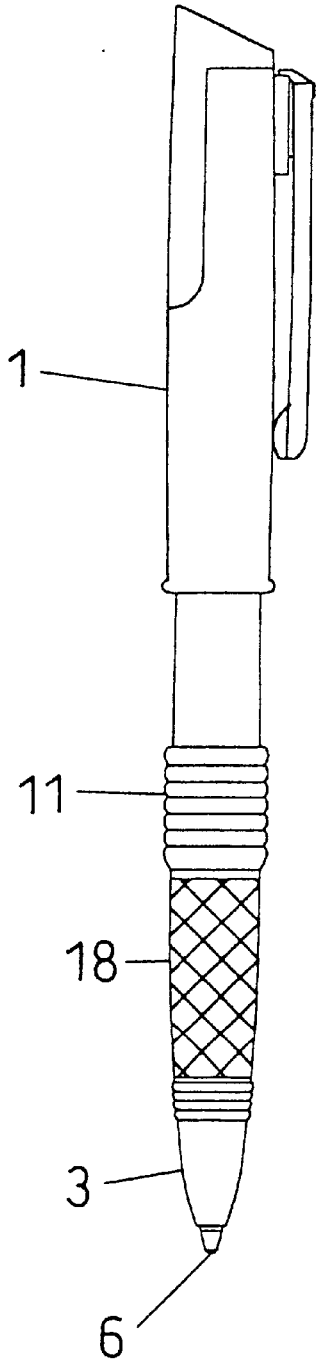
FIG. 1 is an overall view of one exemplary embodiment of the invention with a stamp integrated into the upper part.

FIG. 1 is an overall view of one exemplary embodiment of a handwriting instrument as claimed by the invention.

Figure 2:
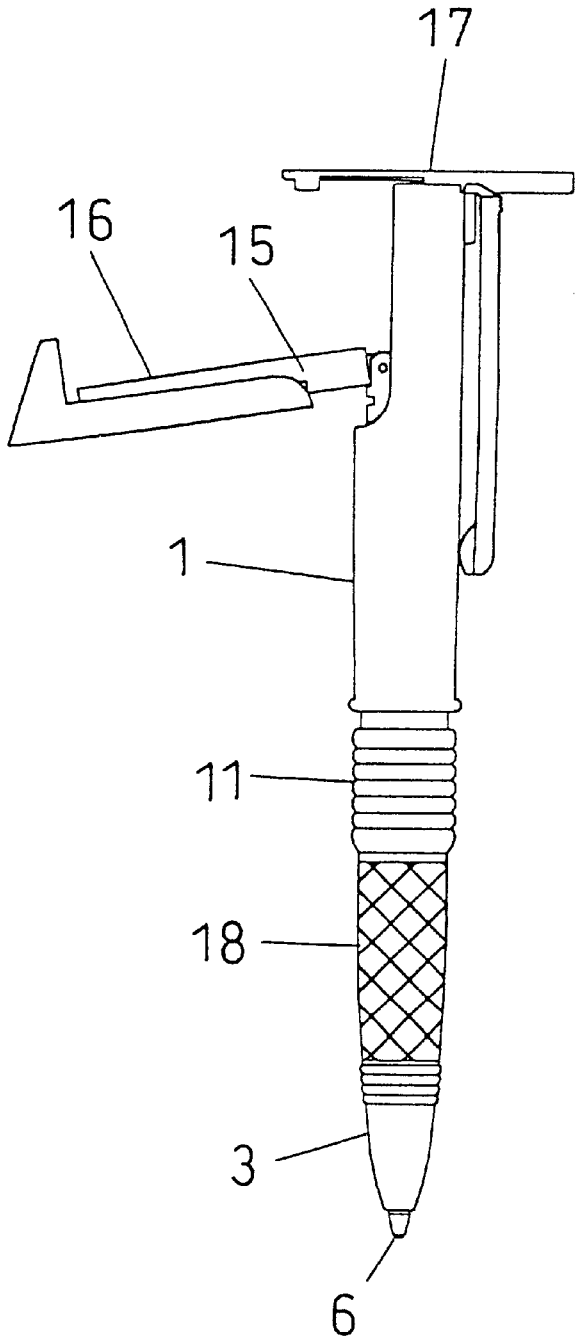
FIG. 2 is an overall view of the exemplary embodiment illustrated in FIG. 1, with the stamp folded up.

Adjacent to the upper part 1, in which are integrated a stamp, a stamp pad holder and a stamp pad, is the intermediate part, which is not visible in FIG. 2 and onto which the tip 3 is screwed. On the intermediate part sit the sleeve 11 and the grip 18, which is preferably made from a soft, non-slip rubber. The tip 6 of the refill projects from the tip 3.

FIG. 2 shows an overall view of the exemplary embodiment illustrated in FIG. 1 with the folded-out stamp 17 and with the stamp pad holder 15 on which the stamp pad 16 lies.

Figure 3:
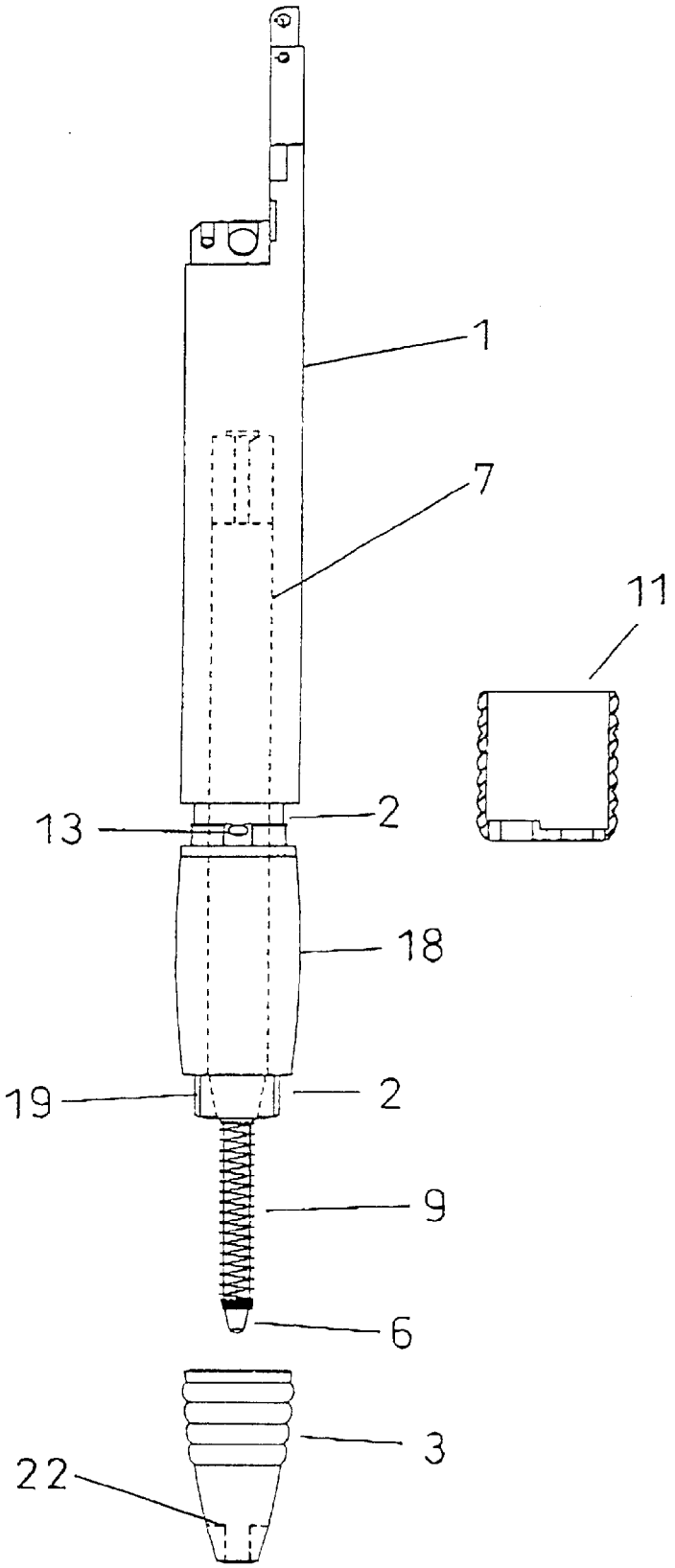
FIG. 3 is an exploded view of the exemplary embodiment without the stamp, stamp pad holder and stamp pad.

FIG. 3 shows an exploded view of the exemplary embodiment illustrated in FIG. 1, but without the stamp, stamp pad holder and stamp pad.

A refill 7 with a tip 6 is inserted into the handwriting instrument. The intermediate part 2, on which two preferably oval studs 13 are located, is inserted into the upper part 1. Next to it, shown in the same relative position, the figure shows the sleeve 11, which is fastened by means of a bayonet connection, to which the studs 13 of the intermediate part 2 belong, when it has been installed on the intermediate part. Between a stop on the refill 7 and a stop 22 in the tip 3 there is a compression spring 9 on the refill 7 which, when the instrument is assembled, holds the refill 7 in the rest position, as in conventional ball-point pens.

Figure 4:
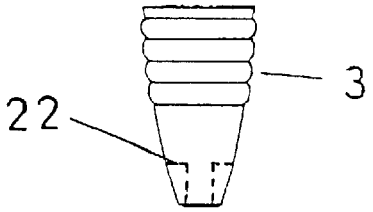
FIG. 4 is a longitudinal section through the upper part as well as a side view of the intermediate part and the tip.

FIG. 4 shows, in the same relative orientation, a longitudinal section through the top part 1 and a side view of the intermediate part 2 and the tip 3.

Provided in the lower end of the upper part 1 there are two opposite detent elements 5, however, only one of which is visible in the drawing. On one end of a detent element 5 there is a trough 10 in which the flexible studs 4 of the intermediate part 2 are locked. On the lower end of the upper part 1 there are also two lead-in bevels 8 which, when the intermediate part 2 is inserted into the upper part 1, guide the flexible studs 4, which are thereby easily locked in the detent elements 5.

In the upper portion of the intermediate part 2, there are two flexible studs 4 opposite each other. Underneath them are located two preferably oval studs 13. Only one of the studs 4 and one of the studs 13 are visible in FIG. 4. On the lower end of the intermediate part 2, a male thread 19 is provided, onto which the tip 3 is screwed.

Figure 5:
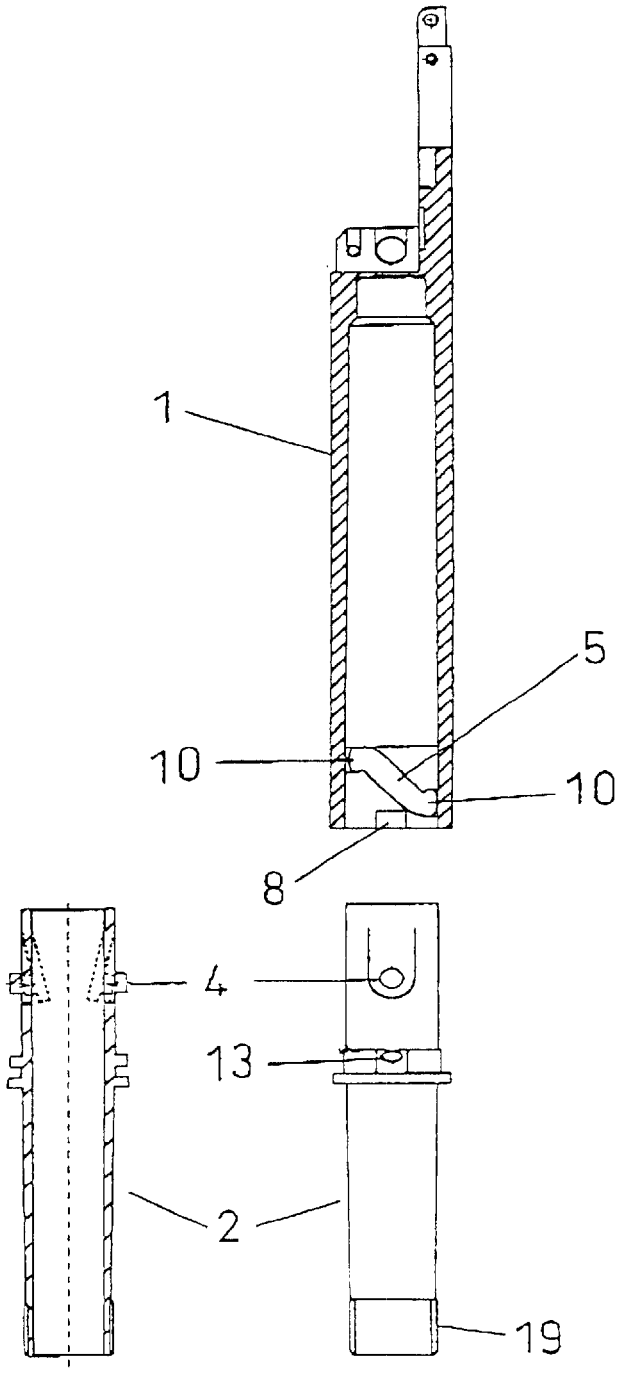
FIG. 5 is a longitudinal section through the intermediate part.

In addition to FIG. 4, FIG. 5 shows, in the same relative orientation, a longitudinal section through the intermediate part 2.

This longitudinal section shows the studs 4 in the removed or integrated position, and in dotted lines during the insertion into the lead-in bevels 8.

Figure 6:
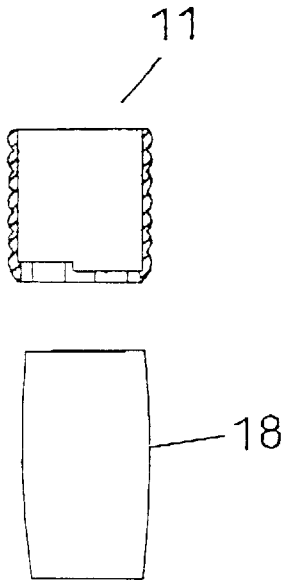
FIG. 6 is a longitudinal section through the sleeve and the grip in a side view.

In addition to FIG. 4, FIG. 6 also shows, in the same relative orientation, the sleeve 11, including the grip 18 in the same relative orientation.

Figure 7:
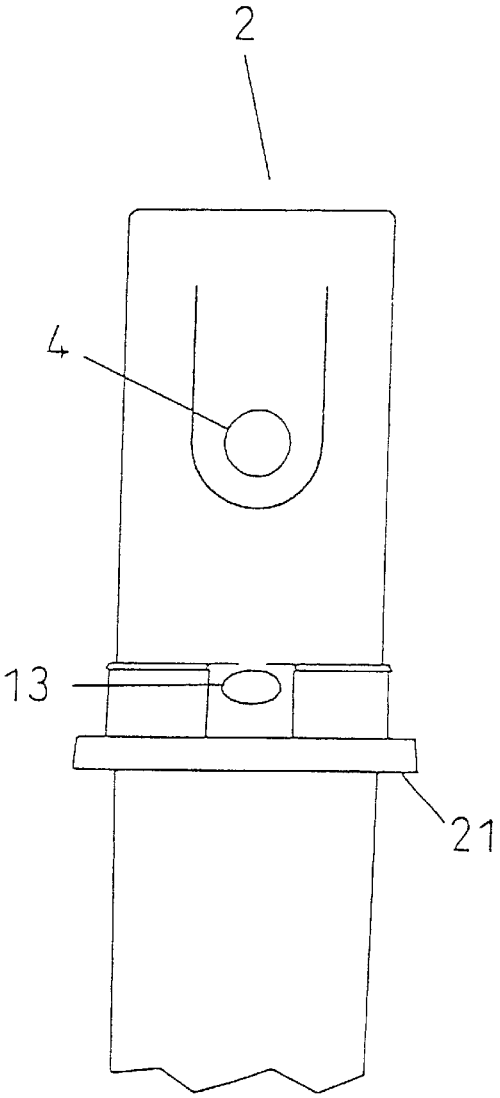
FIG. 7 shows the upper end of the intermediate part with the studs.

FIG. 7 shows the upper end of the intermediate part 2.

Figure 8:
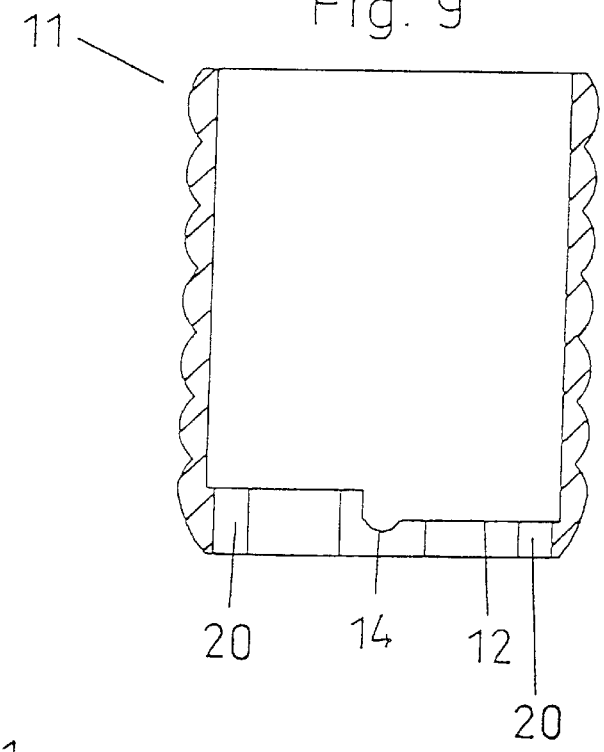
FIG. 8 is a longitudinal section through the sleeve.

The two flexible studs 4 on the intermediate part 2 are located opposite each other. Located below the two studs 4 are the two likewise opposite studs 13, which preferably have an oval shape. Next to FIG. 7, FIG. 8 shows the sleeve 11 in longitudinal section, and on the lower end of the sleeve 11 are two grooves 12, two troughs 14 and two guide openings 20. The sleeve 11 is inserted on the upper end of the intermediate part 2, so that the studs 13 of the intermediate part 2 slide through the two guide openings 20. When the sleeve 11 is rotated, the studs 13 slide in the grooves 12 until they catch in the troughs 14. As an abutment there is a flange 21 attached to the intermediate part 2, against which flange the lower end of the sleeve 11 is pressed by the studs 13.

Figure 9:
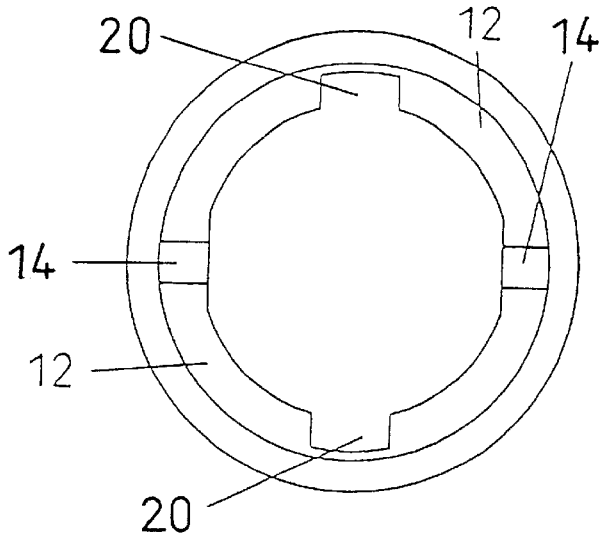
FIG. 9 shows the sleeve from below.

FIG. 9 shows the sleeve 11 from below.

Provided into the lower edge of the sleeve 11 are the two opposite troughs 14 and the two opposite guide openings 20. A trough 14 and a guide opening 20 are offset from each other by an angle of 90°.

The handwriting instrument claimed by the invention is characterized on one hand by a stable and sturdy structure, and on the other hand can be assembled quickly and economically from a small number of individual parts. It is suitable in particular for ball-point pens—with and without the integrated stamp. However, instead of a ball-point pen with refill cartridge, the invention can be used with a felt pen with refill cartridge, a mechanical pencil with refill lead, or another type of refill cartridge can also be used.

REFERENCE NUMBER LIST

1 Top part
2 Intermediate part
3 Tip
4 Flexible studs
5 Detent element
6 Tip of a refill
7 Refill
8 Lead-in bevel
9 Compression spring
10 Trough
11 Sleeve
12 Groove
13 Studs
14 Trough
15 Stamp pad holder
16 Stamp pad
17 Stamp
18 Grip
19 Male thread
20 Guide opening
21 Flange

What is claimed is:

1. A handwriting instrument containing a refill and comprising:

a top part (1) having an upper end and a lower end, an intermediate part (2) having an upper end and a lower end, a tip (3) that can be fastened to the lower end of the intermediate part (2), and a refill adapted to be inserted inside the handwriting instrument;

wherein said refill includes a writing tip, wherein at least one flexible stud (4) located on the upper end of the intermediate part (2) is guided in a diagonal detent element (5) of the top part (1) so that the intermediate part (2) can be displaced in the longitudinal direction relative to the top part (1) by rotating the intermediate part (2) relative to the top part (1), whereby depending on the direction of rotation, the writing tip (6) of the refill (7) can be exposed or covered by the handwriting instrument tip (3), and wherein the lower end of the top part (1) includes at least one lead-in bevel (8) to guide the at least one stud (4) during insertion of the intermediate part (2) into the top part (1).

2. A handwriting instrument as in claim 1, wherein a compression spring is located between (a) a stop provided in the handwriting instrument tip and (b) the refill, wherein said detent element includes a first end and a second end, and wherein a trough to lock each stud is provided at each end of the detent element.

3. A handwriting instrument as in claim 1, further comprising a sleeve fastened to the intermediate part and covering the at least one stud and the detent element.

4. A handwriting instrument containing a refill and comprising:

a top part (1) having an upper end and a lower end, an intermediate part (2) having an upper end and a lower end, a tip (3) that can be fastened to the lower end of the intermediate part (2), and a refill adapted to be inserted inside the handwriting instrument;

wherein said refill includes a writing tip, wherein at least one flexible stud (4) located on the upper end of the intermediate part (2) is guided in a diagonal detent element (5) of the top part (1) so that the intermediate part (2) can be displaced in the longitudinal direction relative to the top part (1) by rotating the intermediate part (2) relative to the top part (1), whereby depending on the direction of rotation, the writing tip (6) of the refill (7) can be exposed or covered by the handwriting instrument tip (3), wherein the lower end of the top part (1) includes at least one lead-in bevel (8) to guide the at least one stud (4) during insertion of the intermediate part (2) into the top part (1); and wherein a sleeve is fastened to the intermediate part by means of a bayonet connection.

5. A handwriting instrument containing a refill and comprising:

a top part (1) having an upper end and a lower end, an intermediate part (2) having an upper end and a lower end, a tip (3) that can be fastened to the lower end of the intermediate part (2), and a refill adapted to be inserted inside the handwriting instrument;

wherein said refill includes a writing tip, wherein at least one flexible stud (4) located on the upper end of the intermediate part (2) is guided in a diagonal detent element (5) of the top part (1) so that the intermediate part (2) can be displaced in the longitudinal direction relative to the top part (1) by rotating the intermediate part (2) relative to the top part (1), whereby depending on the direction of rotation, the writing tip (6) of the refill (7) can be exposed or covered by the handwriting instrument tip (3), and wherein the lower end of the top part (1) includes at least one lead-in bevel (8) to guide the at least one stud (4) during insertion of the intermediate part (2) into the top part (1); and wherein two grooves are provided into a sleeve to guide two studs located on the intermediate part, and wherein troughs are provided into the end of the grooves to lock the studs.

6. A handwriting instrument as in claim 1, wherein a grip made of rubber is seated on the intermediate part.

7. A handwriting instrument as in claim 1, wherein a stamp and a stamp pad holder with an inserted stamp pad are incorporated in the top part, both of which can be pivoted between a rest position and a stamping position.

8. A handwriting instrument as in claim 1, wherein said refill is selected from the group consisting of a ball point pen cartridge, a felt tip pen cartridge, and a mechanical pencil lead.

* * * * *